US006959703B1

(12) United States Patent
Spurlock et al.

(10) Patent No.: US 6,959,703 B1
(45) Date of Patent: Nov. 1, 2005

(54) PAINTBALL GUN THROTTLE REGULATOR DEVICE

(76) Inventors: Michael Steven Spurlock, 1172 W. I-65 Service Rd., South, Mobile, AL (US) 36609; Hsin Cheng Yeh, No. 132, Cheng Nan 1st Street, Yung Kang City, Tainan Hsien (TW)

( * ) Notice: Subject to any disclaimer, the term of this patent is extended or adjusted under 35 U.S.C. 154(b) by 0 days.

(21) Appl. No.: 10/863,471

(22) Filed: Jun. 9, 2004

(51) Int. Cl.[7] ..... F41B 11/00
(52) U.S. Cl. ..... 124/74; 124/73; 124/76; 137/86; 137/871
(58) Field of Search ..... 124/73, 74, 76; 137/86, 871

(56) References Cited

U.S. PATENT DOCUMENTS 5,265,582 A * 11/1993 Bhogal ..... 124/73
5,755,213 A * 5/1998 Gardner et al. ..... 124/73
2004/0187929 A1 * 9/2004 Carroll

FOREIGN PATENT DOCUMENTS

WO WO 98/30859 * 7/1998 ..... 124/73

* cited by examiner

*Primary Examiner*—Michael J. Carone
*Assistant Examiner*—Lulit Semunegus
(74) *Attorney, Agent, or Firm*—Rosenberg, Klein & Lee

(57) ABSTRACT

A paintball gun throttle regulator device includes a body, an adjusting bolt, an elastic element, an adjusting piston, and a cocking. The body comprises a piston chamber, an air chamber next to the piston chamber, and a connecting chamber. The piston chamber and the connecting chamber are formed with threads inside and comprise air release holes, respectively. The air chamber is interconnected with the connecting chamber by through holes. The air chamber comprises an air outlet. The adjusting bolt is threadedly connected to the piston chamber with one end engaging with one end of the elastic element which has another end engaged with one end of the adjusting piston. The adjusting piston is slid into the piston chamber. The adjusting piston has another end secured with one end of the cocking. The cocking has another end extending through the piston chamber and the air chamber and into the connecting chamber.

1 Claim, 6 Drawing Sheets

PAINTBALL GUN THROTTLE REGULATOR DEVICE

BACKGROUND OF THE INVENTION

1. Field of the Invention

This invention relates to a paintball gun throttle regulator device, and more particularly to an automatic retreat and continuous shooting device.

2. Description of the Prior Art

A conventional paintball gun, as shown in FIG. 6 comprises a barrel 9 having a connector 91 underneath to connect with an air valve 81 of an air tank 8. The connector 91 is connected to a handle 93 through a high-pressure pipeline 92. The air valve 81 of the air tank 8 comprises a piston valve 82 with a cocking 821 at the front end to receive a washer 822. The rear end of the piston valve 82 is engaged with one end of an elastic element 83. The other end of the elastic element 83 is engaged with a nut 84 which has a hole at the center to be interconnected with the air tank 8. The elastic element 83 urges the cocking 821 to extend outward from the piston valve 82, while the washer 822 seals the air valve 81 and the air tank 8. The connector 91 of the barrel 9 has a connecting room 911 at one end and a connecting chamber 914 at the other end thereof. Both the connecting room 911 and the connecting chamber 914 are interconnected at the center with a through hole 913. The connecting room 911 comprises a protuberance 912 at the inner wall adapted to urge the cocking 821. The high-pressure pipeline 92 comprises a pair of quick-release connectors 921 and 922 at two ends to connect with the connecting chamber 914 of the connector 91 and a connecting chamber 931 of the handle 93, respectively. The handle 93 comprises an air passage 932 in connection with an air storage room 933. The air passage 932 comprises an adjusting valve 934 which is adjustable by an adjusting cone 935 of the handle 93. This product has a few shortcomings:

1. The controllability and safety are less accountable.
2. The pressure to shoot paintball is weak.

In view of these, the inventor has derived the present invention to correct the shortcomings.

SUMMARY OF THE INVENTION

It is the primary object of the present invention to provide a paintball gun throttle regulator device, which has an instant power to shoot the paintball.

It is another object of the present invention to provide a paintball gun throttle regulator device, which is easy to adjust the air pressure.

It is a further object of the present invention to provide a paintball gun throttle regulator device, which is safe.

DETAILED DESCRIPTION OF THE PREFERRED EMBODIMENT

Figure 1:
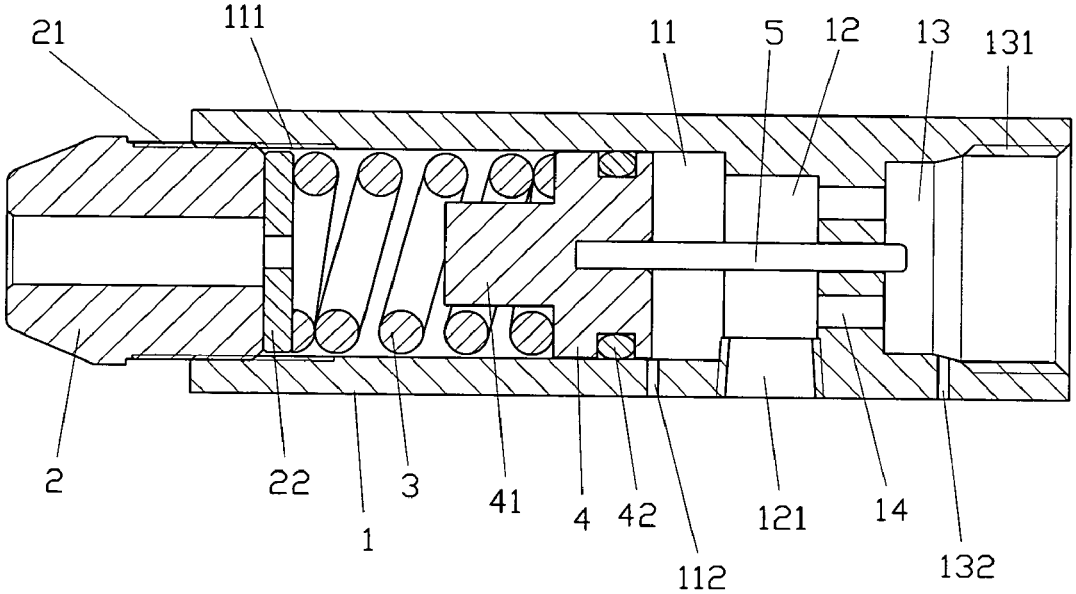
FIG. 1 is a side cross-sectional view of the present invention.

As shown in FIG. 1, the present invention comprises a body 1, an adjusting bolt 2, an elastic element 3, an adjusting piston 4 and a cocking 5.

The body 1 comprises a piston chamber 11, an air chamber 12 next to the piston chamber 11, a connecting chamber 13 interconnected with the air chamber 12 by through holes 14. Both the piston chamber 11 and the connecting chamber 13 are formed with threads 111 and 131 inside and have air release holes 112 and 132, respectively. The air chamber 12 comprises an outlet 121. The elastic element 3, the adjusting piston 4 and the cocking 5 are mounted in the piston chamber 11 of the body 1. The adjusting bolt 2 is threadedly connected to the piston chamber 11 with threads 21 threading with the threads 111 in such a manner that the position of the adjusting bolt 2 with respect to the body 1 is adjustable. The adjusting bolt 2 is engaged with a washer 22 to one end of the elastic element 3, while the other end of the elastic element 3 is engaged with a protuberance 41 of the adjusting piston 4. The adjusting piston 4 has one end sealed with a washer 42 and is sleeved into the piston chamber 11. The endmost end of the adjusting piston 4 is secured with one end of the cocking 5 which has another end inserted through the piston chamber 11 and the air chamber 12 and into the connecting chamber 13.

Figure 2:
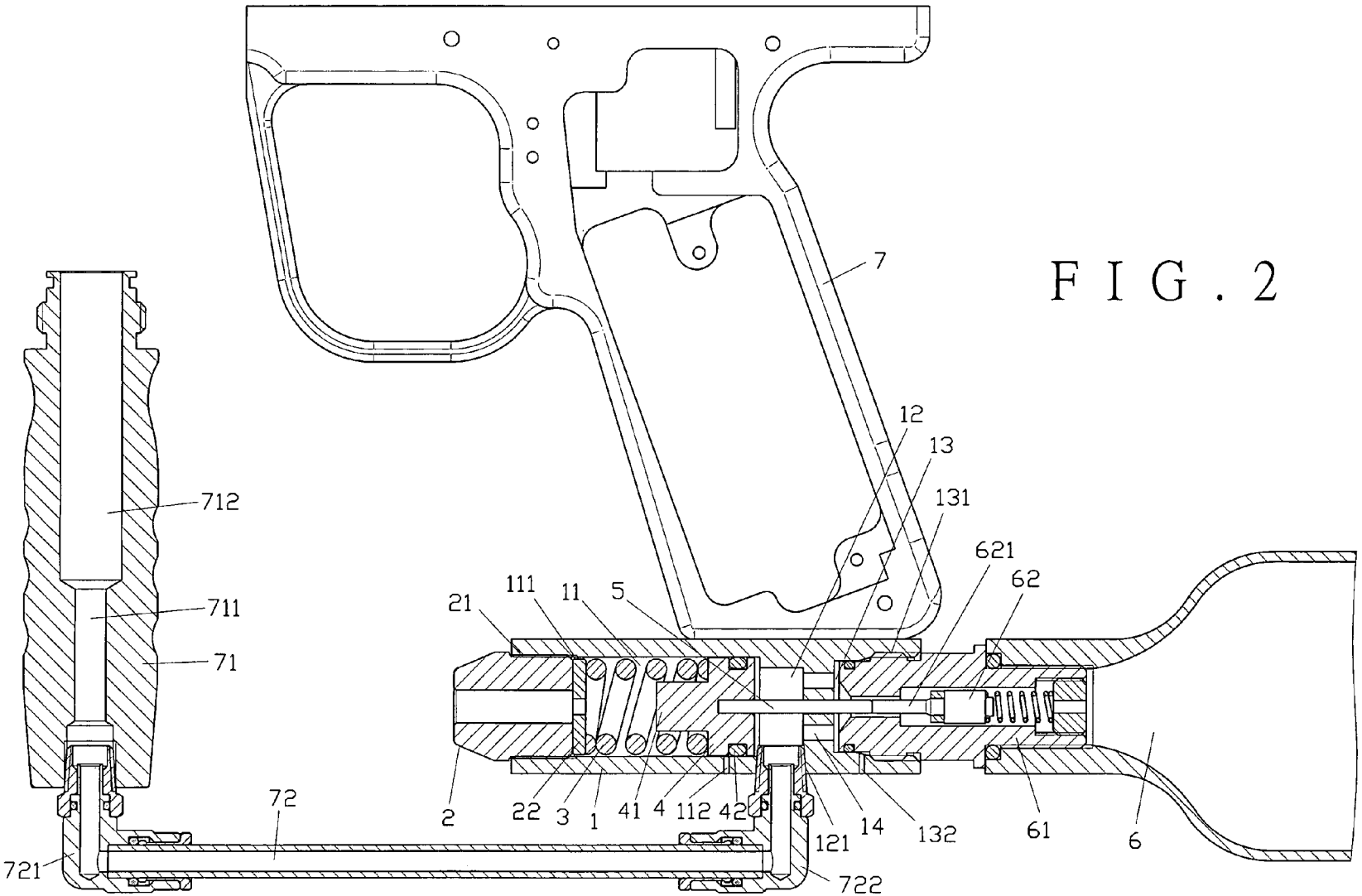
FIG. 2 is a side cross-sectional view of the present invention coupled with a paintball gun.

In practice, as shown in FIG. 2, the present invention is coupled with an air tank 6 having an air valve 61 and a barrel 7. The air valve 61 comprises a piston valve 62 and a cocking 621. They are similar to the prior arts, therefore, will not be described hereinafter. The barrel 7 comprises a handle 71 and a high-pressure pipeline 72. The high-pressure pipeline 72 comprises a pair of quick-release connectors 721 and 722 at two ends to connect with the handle 71 and the outlet 121 of the air chamber 12, respectively. The handle 71 comprises an air passage 711 which is connected to an air storage room 712. Because the adjusting bolt 2, the elastic element 3, the adjusting piston 4 and the cocking 5 are all mounted in the body 1, the air storage room 712 may be expanded to increase air volume to maintain a stable air flow when shooting.

Figure 3:
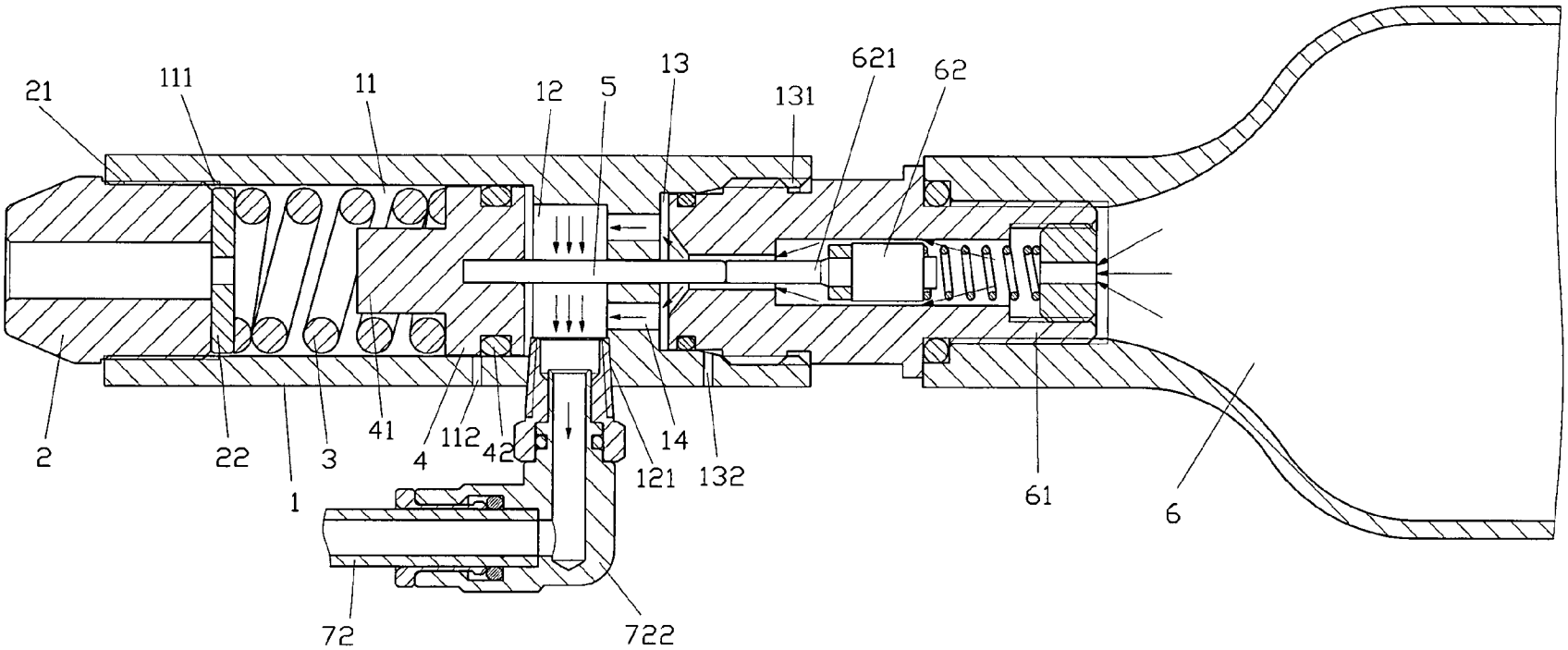
FIG. 3 is a cross-sectional view showing air flow routing.
Figure 4:
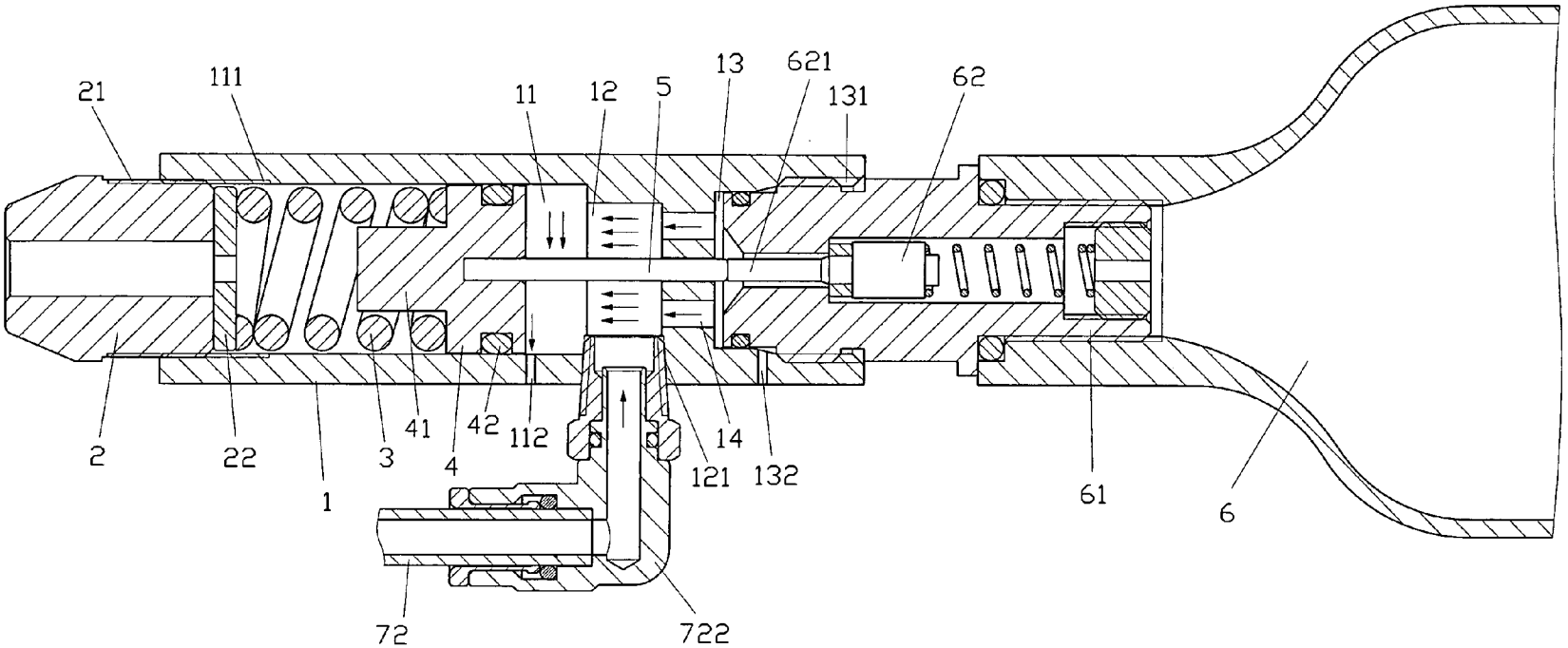
FIG. 4 is a cross-sectional view showing air release routing.
Figure 5:
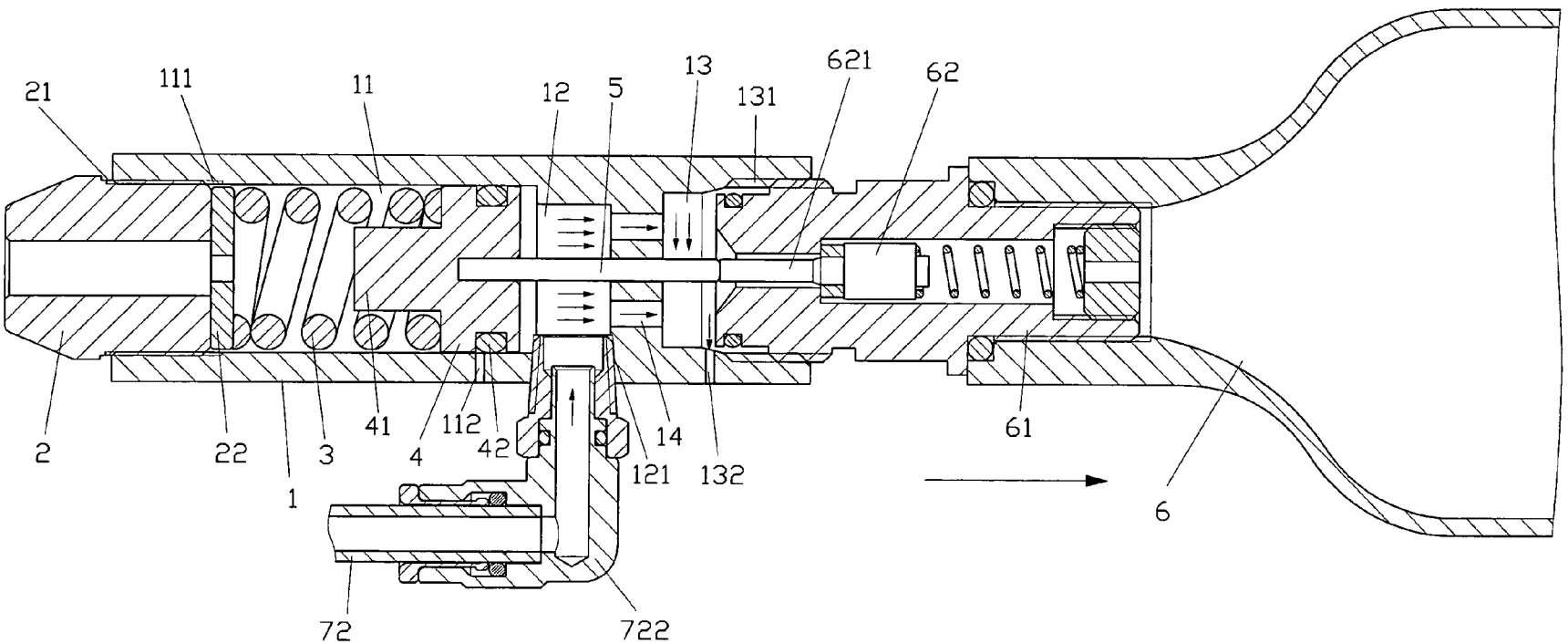
FIG. 5 is a cross-sectional view showing air release status when a gas tank is detached from the paintball gun.
Figure 6:
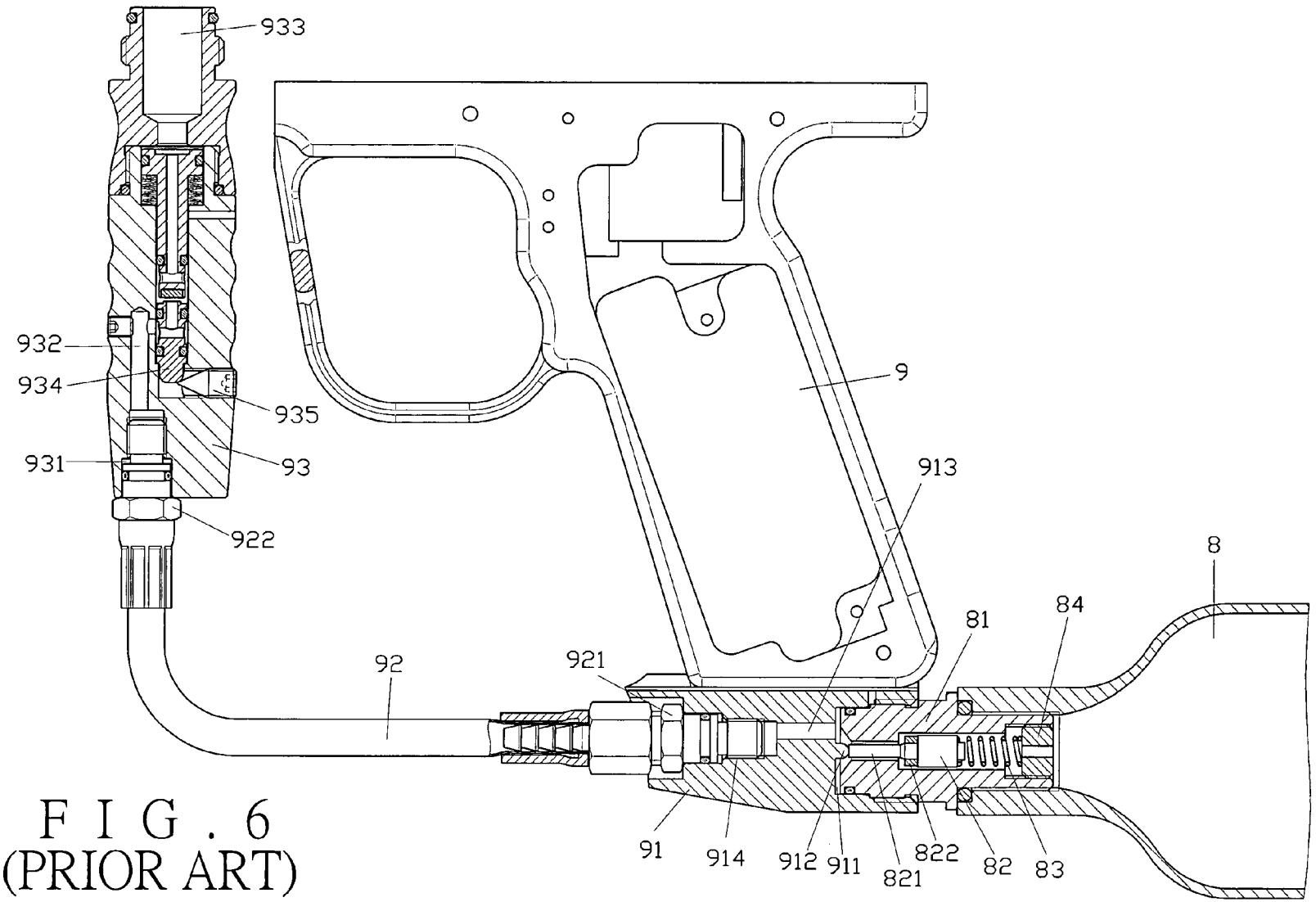
FIG. 6 (PRIOR ART)
FIG. 6 is a side cross-sectional view of a prior paintball gun.

To operate the present invention, as shown in FIG. 3, when the cocking 5 pushes the cocking 621 of the piston valve 62, high pressure air blows from the air tank 6 and through the through holes 14, the air chamber 12 and out of the outlet 121. When the adjusting bolt 2 is released and the cocking 5 is disengaged from the cocking 621 of the piston valve 62, high pressure air stops blowing from the air tank 6. The piston chamber 11 and the air chamber 12 of the body 1 still remain residue air which will be released from the air release hole 112 for safety reason, as shown in FIG. 4. When the air tank 6 is detached from the paintball gun, as shown in FIG. 5, the residue air within the air chamber 12 and the connecting chamber 13 may be released through the air release hole 132 for safety purpose.

What is claimed is:

1. A paintball gun throttle regulator device comprising a body, an adjusting bolt, an elastic element, an adjusting piston and a cocking, wherein:

said body comprising a piston chamber, an air chamber next to said piston chamber, and a connecting chamber, said piston chamber and said connecting chamber comprising threads inside, said air chamber being interconnected with said connecting chamber by through holes, said piston chamber and said connecting chamber comprising an air release hole, respectively, said air chamber comprising an air outlet, said elastic element, said adjusting piston, and said cocking being mounted within said piston chamber of said body, said adjusting bolt being threadedly connected to said piston chamber in such a manner that the position of said adjusting bolt with respect to said body is adjustable, said adjusting bolt being engaged with one end of said elastic element, another end of said elastic element being engaged with one end of said adjusting piston, said adjusting piston being slid into said piston chamber, said adjusting piston having another end secured with one end of said cocking, another end of said cocking extending through said piston chamber and said air chamber and into said connecting chamber.

* * * * *